US012686422B2

(12) United States Patent
Hua et al.

(10) Patent No.: US 12,686,422 B2
(45) Date of Patent: Jul. 21, 2026

(54) SCREEN DOOR CONTROL METHOD SUPPORTING BOTH COUPLING AND BAGGAGE CARRIAGE

(71) Applicant: CASCO SIGNAL LTD., Shanghai (CN)

(72) Inventors: Zhichen Hua, Shanghai (CN); Xinjun Lv, Shanghai (CN); Ming Chang, Shanghai (CN); Qiaona Ma, Shanghai (CN); Yanyan Liu, Shanghai (CN)

(73) Assignee: CASCO SIGNAL LTD., Shanghai (CN)

( * ) Notice: Subject to any disclaimer, the term of this patent is extended or adjusted under 35 U.S.C. 154(b) by 3 days.

(21) Appl. No.: 19/108,689

(22) PCT Filed: Nov. 16, 2023

(86) PCT No.: PCT/CN2023/131914
§ 371 (c)(1),
(2) Date: Mar. 4, 2025

(87) PCT Pub. No.: WO2025/000823
PCT Pub. Date: Jan. 2, 2025

(65) Prior Publication Data

US 2025/0388246 A1 Dec. 25, 2025

(30) Foreign Application Priority Data

Jun. 27, 2023 (CN) ..... 202310769703.X

(51) Int. Cl.
*B61L 15/00* (2006.01)

(52) U.S. Cl.
CPC ..... *B61L 15/0063* (2013.01); *B61L 15/0072* (2013.01)

(58) Field of Classification Search
CPC ..... B61L 15/0063; B61L 15/0072
See application file for complete search history.

(56) References Cited

U.S. PATENT DOCUMENTS

2010/0063632 A1* 3/2010 Tate ..... B61B 1/02 700/275
2010/0180790 A1* 7/2010 Losito ..... B61B 1/02 104/30

(Continued)

FOREIGN PATENT DOCUMENTS

CN 203805889 U 9/2014
CN 112396739 A 2/2021

(Continued)

OTHER PUBLICATIONS

International Search Report (with English translation) and Written Opinion issued in PCT/CN2023/131914, mailed Jan. 24, 2024.

*Primary Examiner* — Long T Tran
(74) *Attorney, Agent, or Firm* — HSML P. C.

(57) ABSTRACT

The present invention relates to a screen door control method supporting both coupling and a baggage carriage, a device, and a medium. The method includes: S1, calculating data of a safe passenger boarding and alighting area in an onboard electronic map library based on train running rules and train formations allowed for online running; S2, merging, by an interlocking system based on the train running rules and the train formations allowed for online running, same opening codes for actually opening screen doors in data logic; S3, calculating, by an onboard controller, a screen door opening code based on a current actual train formation, a baggage carriage condition, and data of a safe passenger boarding and alighting area in which the current train formation is located; and S4, driving, by the interlocking system, a corresponding screen door to be opened. Compared with the prior art, the present invention has advantages of supporting an operation manner of replacing a first carriage at a head or tail of different train formations with a baggage carriage, and the like.

16 Claims, 4 Drawing Sheets

(56) References Cited

U.S. PATENT DOCUMENTS

| | | | | |
|---|---|---|---|---|
| 2012/0120234 | A1* | 5/2012 | Fullalove | B61B 1/02 49/70 |
| 2014/0326159 | A1* | 11/2014 | Kim | E21F 1/00 104/27 |
| 2015/0040480 | A1* | 2/2015 | Reichling | B61B 1/02 49/24 |
| 2021/0037215 | A1* | 2/2021 | Hirai | H04N 7/181 |
| 2021/0131163 | A1* | 5/2021 | Ding | B61B 1/02 |
| 2021/0293076 | A1* | 9/2021 | Enrich Tudela | B61B 1/02 |
| 2021/0362757 | A1* | 11/2021 | Oh | B61L 15/0081 |
| 2022/0089205 | A1* | 3/2022 | Yamamoto | H04N 7/181 |
| 2022/0381079 | A1* | 12/2022 | Vautier | E05F 15/635 |
| 2023/0311959 | A1* | 10/2023 | Chai | B61L 23/34 701/19 |

FOREIGN PATENT DOCUMENTS

| | | | |
|---|---|---|---|
| CN | 114644020 | A | 6/2022 |
| CN | 115320644 | A | 11/2022 |
| CN | 115339490 | A | 11/2022 |
| CN | 115788223 | A | 3/2023 |
| CN | 116811924 | A | 9/2023 |
| DE | 102014205848 | A | 10/2015 |
| WO | 2018071991 | A1 | 4/2018 |

* cited by examiner

SCREEN DOOR CONTROL METHOD SUPPORTING BOTH COUPLING AND BAGGAGE CARRIAGE

FIELD OF TECHNOLOGY

The present invention relates to a screen door control technology in the rail transit field, and in particular to a screen door control method supporting both coupling and a baggage carriage, a device, and a medium.

BACKGROUND

As the tidal passenger flow phenomenon of urban rail transit becomes increasingly prominent, the demand for flexible train formation in urban rail transit is becoming increasingly urgent. During a heavy passenger flow period in the morning and evening rush hours, a plurality of train units are used for long formation and coupling operation, which can greatly increase the passenger capacity. During an off-peak period, a single train unit is used for short formation operation, which can reduce operation costs and achieve the purpose of energy conservation and environmental protection while meeting the passenger flow. In addition, with the increasing popularity of urban airport terminals and the increasing demand for the use of some train carriages for carrying cargo during off-peak hours, one carriage in the train formation is replaced with a baggage carriage, which has also become a new operation direction of the urban rail transit.

The two development directions both imply that when passenger boarding on and alighting from a train are performed on the platform, a screen door system can correctly, safely, and reliably open a corresponding quantity of screen doors based on an actual quantity of carriages in the train formation and whether a baggage carriage is mounted. Opening a screen door at an incorrect position may lead to safety issues such as a passenger falling onto a track or being unable to board or alight from the train.

Through retrieval, Chinese patent CN115788223A discloses a platform screen door control method and device for trains with different train formation lengths. The method includes: obtaining current train formation information; receiving, by a screen door unit controller (DCU), a control command for whether to open the door; and based on collected current train formation information and the control command received by the DCU, determining whether to perform door opening. The train formation information is obtained by installing one or more non-contact obstacle detection sensors on platform screen doors.

However, because opening the screen door is a safety-related application, the detection system needs to demonstrate that the opening meets the safety integrity level (SIL4) and has a broad application foundation. In addition, this solution cannot meet the requirement of not opening a corresponding screen door of the baggage carriage.

Chinese patent No. CN203805889U discloses a layout structure of an automatic control system for a subway train. Specifically, the automatic control system at least includes onboard equipment, trackside equipment, and a wireless communication system. The onboard equipment is disposed on the train, the trackside equipment is disposed on a track, the onboard equipment forms a signal connection with the trackside equipment through the wireless communication system, and the trackside equipment is connected and controls opening and closing of the platform screen door.

However, the patent supports only head-end alignment parking and cannot meet a requirement for performing boarding on and alighting from a short train formation in different areas of the platform.

In a field application case of Shanghai Line 16, one train formation has only one unique screen door opening code, which means that one train formation supports only one parking position on the same platform. This results in a train formation including two train units being split into two single-unit trains on the platform. After splitting, passenger boarding and alighting are performed on only a single-unit train on an outer side of the platform. A single-unit train on an inner side of the platform needs to wait until the outer train departs and travel to the outer side of a boarding and alighting area of the platform, and then passenger boarding and alighting are performed. The efficiency of train operation is affected after the train formation is split.

In summary, a technical problem that needs to be addressed is how to implement a screen door control technology that can achieve an SIL4 safety integrity level, support passenger boarding and alighting operations at different positions on the platform for the short train formation, and allow for mounting the baggage carriage.

SUMMARY

The present invention provides a screen door control method supporting both coupling and a baggage carriage, a device, and a medium to overcome the defects in the prior art.

The purpose of the present invention is achieved using the following technical solutions:

According to a first aspect of the present invention, a screen door control method supporting both coupling and a baggage carriage is provided, specifically including:

step S1, calculating data of a safe passenger boarding and alighting area in an onboard electronic map library based on train running rules and train formations allowed for online running, and proceeding to step S2;

step S2, merging, by an interlocking system based on the train running rules and the train formations allowed for online running, same opening codes for actually opening screen doors in data logic, and proceeding to step S3;

step S3, calculating, by an onboard controller, a screen door opening code based on a current actual train formation, a baggage carriage condition, and data of a safe passenger boarding and alighting area in which the current train formation is located, sending the opening code to the interlocking system, and proceeding to step S4; and step S4, driving, by the interlocking system based on merging logic in step S2 and the screen door opening code received from the onboard controller, a corresponding screen door to be opened.

In a preferred technical solution, a smallest unit of the train formation is a train unit, and one train formation includes one or more train units coupled together.

In a preferred technical solution, the safe passenger boarding and alighting area has five attributes: starting point coordinates, the length, a matched train formation type, a screen door area position at an upward end of the train formation, and a screen door area position at a downward end of the train formation.

In a preferred technical solution, the starting point coordinates and the length define an area included in the safe passenger boarding and alighting area.

In a preferred technical solution, the area is set at a different position on each platform based on actual needs of a project.

In a preferred technical solution, the length is determined based on the length of a corresponding train formation and a train positioning error, and the train positioning error is calculated by a train automatic protection system based on beacon placement and odometer or speed sensor accuracy during parking.

In a preferred technical solution, the screen door area position divides screen doors on an entire platform into several non-overlapping parts, and one screen door area is the length corresponding to one train unit.

In a preferred technical solution, the opening codes are merged as follows:

the interlocking system lists, based on the description of the train running rules and a train coupling and formation solution, all screen door opening codes that appear during project operation, and merges completely the same opening codes for actually opening screen doors into opening codes of the same type.

In a preferred technical solution, a method for calculating the screen door opening code is consistent with an interface specification for interoperability, and logic for filling in fields is refined.

In a preferred technical solution, refined fields include:

Bit7, defined as opening from an upward direction or a downward direction of a screen door area position toward a first screen door;

Bit 5-Bit6, defined as screen door area positions; and

Bit0-Bit4, defined as a quantity of train carriages with corresponding screen doors to be opened from a first screen door represented by Bit 5-Bit7 toward an opposite direction represented by Bit7.

In a preferred technical solution, a method for determining the upward direction or downward direction is as follows: if no baggage carriage is provided for the train formations, the direction is a direction indicated by an activated driver's cab; otherwise, the direction is a direction indicated by a non-baggage carriage driver's cab; the screen door area position is: a screen door area position at which the activated driver's cab is located if no baggage carriage is provided for the train formations; otherwise, a screen door area position at which the non-baggage carriage driver's cab is located; and the quantity of train carriages is: a total quantity of carriages comprised in an entire train formation if no baggage carriage is provided for the train formations, or the baggage carriage is provided but a door for the baggage carriage in a current station needs to be opened; otherwise, the total quantity of carriages comprised in the entire train formation minus 1.

In a preferred technical solution, the baggage carriage is a first carriage or last carriage of the entire train formation.

In a preferred technical solution, the calculating data of a safe passenger boarding and alighting area in an onboard electronic map library in step S1 is performed by offline calculation.

In a preferred technical solution, the calculating a screen door opening code in step S3 is performed by online calculation.

According a second technical aspect of the present invention, an electronic device is provided, including a memory and a processor, where a computer program is stored in the memory, and when the processor executes the program, the above method is implemented.

According to a third aspect of the present invention, a computer-readable storage medium that stores a computer program is provided, and when the program is executed by a processor, the above method is implemented.

Compared with the conventional technologies, the present invention has the following advantages.

(1) The present invention supports different train formations, allowing replacement of first carriages at the front or rear with baggage carriages, ensuring safe and correct boarding and alighting operations on the platform.

(2) The present invention supports boarding on and alighting operations from short train formations at different positions of the same platform. After a long train formation undergoes online formation splitting on the platform, short train formations after formation splitting can separately perform boarding and alighting operations at original positions, improving the operation efficiency and reducing the complexity of operations for scheduling and drivers.

(3) The present invention is implemented based on the onboard VOBC and the trackside interlocking system. Both systems and a communication protocol between the systems meet the safety integrity level (SIL4) requirements and are widely applied.

DESCRIPTION OF THE EMBODIMENTS

Figure 1:
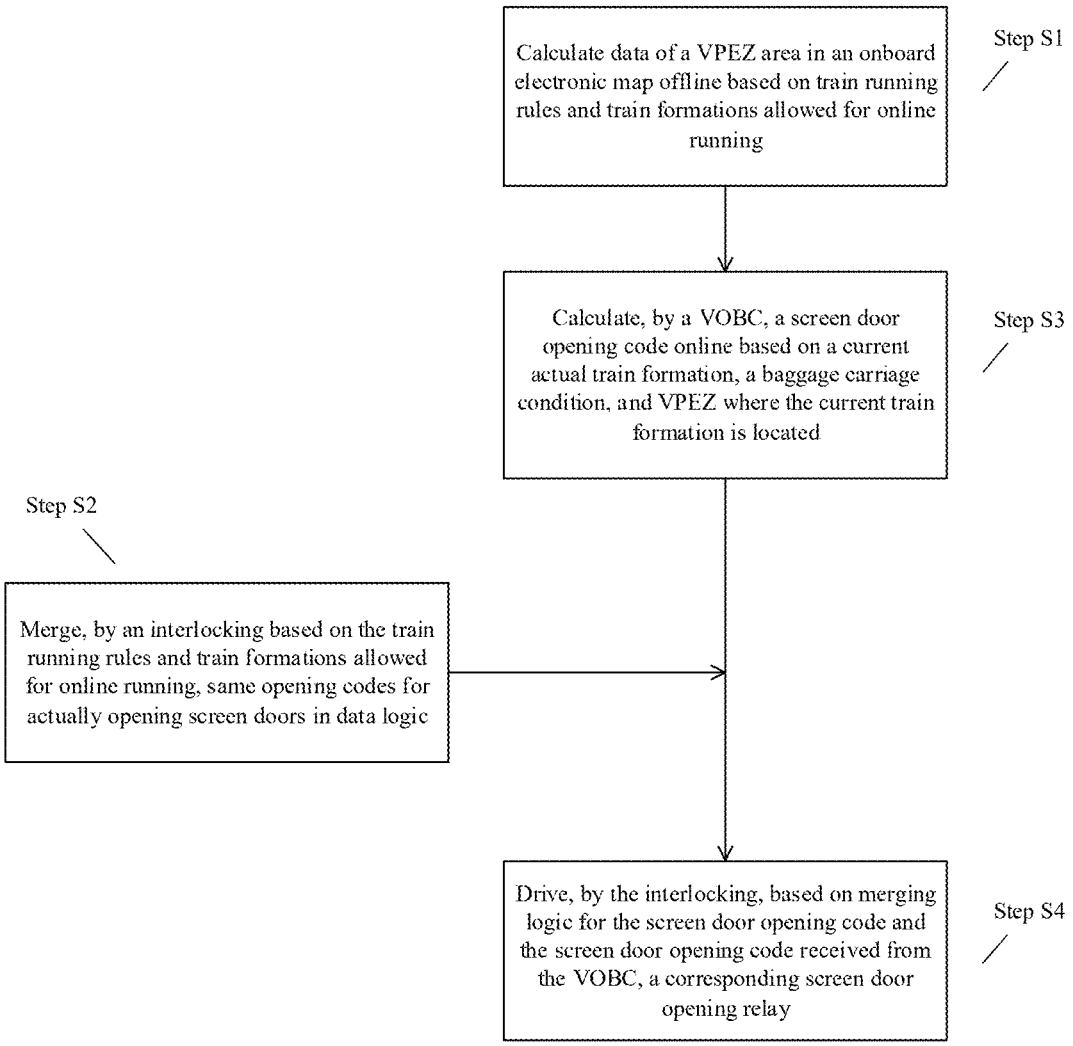
FIG. 1 is a flowchart of a screen door control method supporting both coupling and a baggage carriage according to the present invention.

The technical solutions in the embodiments of the present invention are clearly and completely described below with reference to the accompanying drawings in the embodiments of the present invention. Apparently, the described embodiments are merely some rather than all of the embodiments of the present invention. Based on the embodiments of the present invention, all other embodiments obtained by those of ordinary skill in the art without creative effort shall fall within the protection scope of the present invention.

The present invention is intended to provide a screen door control method supporting both coupling and a baggage carriage, to control a screen door more flexibly.

Definitions

Train unit (TU): a smallest unit constituting a train formation for an engineering project that supports flexible train formation. One train unit can include one or more carriages.

Train formation (TF): configuration of a train that is allowed for online passenger carrying for an engineering project that supports flexible train formation. One train formation may include one train unit or a plurality of train units coupled together.

The screen door control method supporting both coupling and a baggage carriage includes the following three methods.

Method 1: A structure of an onboard electronic map of and a calculation method for a safe passenger boarding and alighting area (hereinafter referred to as VPEZ) applicable to a project with a plurality of flexible train formation types:

the VPEZ has the following five attributes:

1. starting point coordinates of the VPEZ;
2. the length of the VPEZ;
3. a train formation type matched with the VPEZ;
4. a screen door area position at an upward end of a train formation in the VPEZ; and
5. a screen door area position at a downward end of the train formation in the VPEZ.

the starting point coordinates and length of the VPEZ define an area included in the VPEZ, and can be set at different positions on each platform based on actual needs of a project. Train formations of the same type are allowed to be provided with a plurality of VPEZs on the same platform.

The length of a corresponding train formation, as well as a train positioning error calculated by an onboard ATP based on beacon placement and odometer or speed sensor accuracy when the train is parked is considered for the length of the VPEZ. When safety positioning of the train formation is completely within the VPEZ assigned to the train formation, the onboard ATP considers the train to be properly parked.

The position of the screen door area divides screen doors on an entire platform into several non-overlapping parts, and one screen door area is the length corresponding to one TU.

The position of the screen door area of the VPEZ is represented by 2 bits, meaning that on the same platform, one TF including one TU can support door opening at up to three different positions on the platform.

In one VPEZ, two positions of the screen door area are defined. For a TF including a plurality of TUs, positions of a screen door area in which a first TU and last TU are located are defined. For a TF including one TU, the two positions of the screen door area are the same.

Method 2: A method for calculating a screen door opening code from an onboard VOBC to a trackside interlocking system, applicable to a project with a plurality of flexible train formation types. The opening code includes one byte and is consistent with the specification for interoperability T/CAMET 04011.2-2018, but field filling logic is refined as follows:

Bit 7: defined as an upward parking point and a downward parking point in the specification for interoperability, where 0 represents downward, and 1 represents upward. In the present invention, 1 or 0 actually represents whether a first screen door starts to be opened from an upward direction or a downward direction of the position of the screen door area respectively.

Bit5-6: defined as a parking point in the specification for interoperability, and actually defined as the position of the screen door area in the present invention.

In the present invention, based on Bit5-Bit7, it can be determined which screen door on the platform starts to be opened.

Bit0-Bit4: defined as an actual quantity of train formations in the specification for interoperability, and actually defined as a quantity of screen doors, corresponding to train carriages, to be opened from a first screen door represented by Bit5-Bit7 to a direction opposite to Bit7 in the present invention.

A calculation method in a Bit7 direction is as follows:

If no baggage carriage is provided for the train formations, the direction is a direction pointed by an activated driver's cab. If a baggage carriage is provided for the train formations, the direction is a direction pointed by a non-baggage carriage driver's cab. In the present invention, the baggage carriage needs to be a first or last carriage of the entire train formation).

A calculation method for Bit5-Bit 6 is as follows:

If no baggage carriage is provided for the train formations, the position is a screen door area position at which the activated driver's cab is located. If a baggage carriage is provided for the train formations, the position is a screen door area position at which the non-baggage carriage driver's cab is located.

A calculation method for Bit0-Bit 4 is as follows:

If no baggage carriage is provided for the train formations, or a baggage carriage is provided but a door for the baggage carriage is to be opened at a current station, a quantity of carriages included in the entire train formation is sent, or else, the quantity minus by 1 is sent.

Method 3: A method for combining different door opening codes that may be received by an interlocking system.

The interlocking system lists, based on the description of train running rules in a project and an allowed online train coupling and formation solution, all opening codes for the screen doors that may appear during project operation. In data merging logic, completely the same screen door opening codes for actually opening screen doors are merged into opening codes of the same type. To be specific, when screen door opening codes of the same type are received from the VOBC, the same door-opening relay interfacing with the screen door system is driven. Therefore, an interface between the interlocking system and the screen door system and the complexity of engineering implementation are simplified.

FIG. 1 is a flowchart of the present invention. VPEZ data in an onboard electronic map and the opening codes for the screen doors in interlocking system data logic can be merged for calculation offline based on the train running rules of a project and an allowed online train formation. During train running, the onboard VOBC calculates a corresponding screen door opening code based on related attributes of the VPEZ of a platform in which the train is actually parked and combined with train formation conditions (such as a quantity of carriages and whether a baggage carriage is included), and then the opening code is sent to the interlocking system through train-to-ground wireless communication. The interlocking system drives a corresponding screen door opening relay based on the received screen door opening code, and the screen door system opens a corresponding screen door accordingly.

In the following example, one train unit includes three carriages, and a black carriage in the figure represents a baggage carriage.

Figure 2:
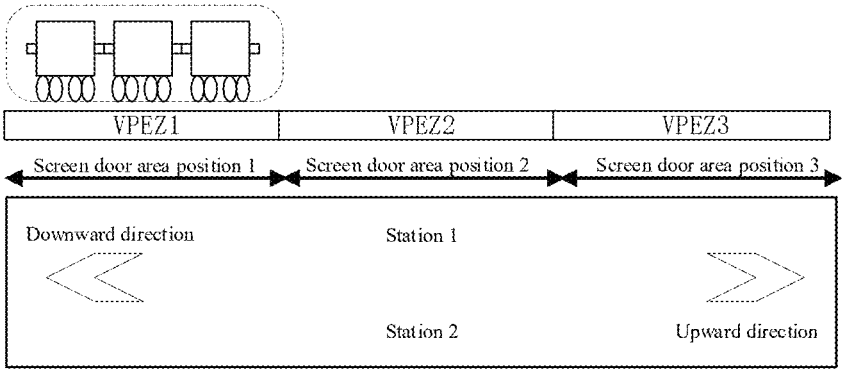
FIG. 2 is a schematic diagram of VPEZ for a train formation including one train unit according to the present invention.

As shown in FIG. 2, for a train formation including a single train unit, three different VPEZs can be disposed on the platform. The boarding and alighting operations can be performed on the train formation by opening and closing a screen door in any one of VPEZ1 to VPEZ3.

In FIG. 2, when the train formation is parked in VPEZ1 and is not provided with a baggage carriage (all screen doors in a range of the train formation need to be opened), a screen door opening code sent by the VOBC is (bit7-bit0):

1 01 00011 (a driver's cabin activated in an upward direction)

0 01 00011 (a driver's cabin activated in a downward direction)

In this case, for the interlocking system, the two opening codes need to be recognized in data logic as representing opening all screen doors in a screen door area position 1 and driving the same screen door opening relay.

Figure 3:
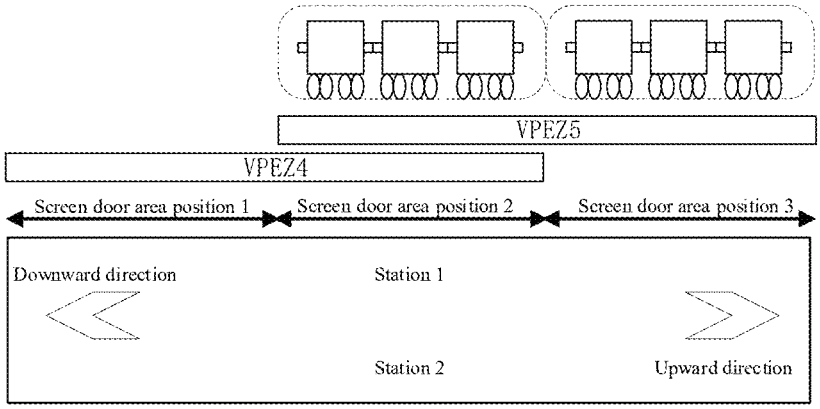
FIG. 3 is a schematic diagram of VPEZ for a train formation including two train units according to the present invention.

As shown in FIG. 3, for a train formation including two train units, two different VPEZs can be disposed on the platform. The boarding and alighting operations can be performed on the train formation by opening and closing screen doors in any one of VPEZ4 and VPEZ5.

In FIG. 3, when the train formation is parked in VPEZ5 and is not provided with a baggage carriage (all screen doors in a range of the train formation need to be opened), a screen door opening code sent by the VOBC is (bit7-bit0):

1 11 00110 (a driver's cabin activated in an upward direction)

0 10 00110 (a driver's cabin activated in a downward direction)

In this case, for the interlocking system, the two opening codes need to be recognized in data logic as representing opening all screen doors in a screen door area position 2 and a screen door area position 3 and driving the same screen door opening relay.

Figure 4:
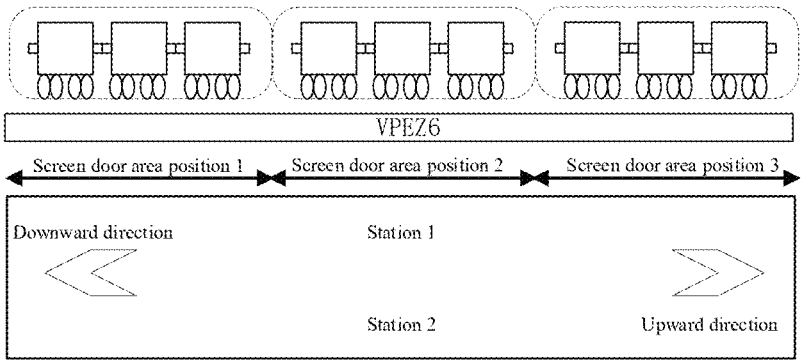
FIG. 4 is a schematic diagram of VPEZ for a train formation including three train units according to the present invention.

As shown in FIG. 4, for a train formation including three train units, passenger boarding and alighting can be performed on the train formation in the VPEZ6 by opening and closing a screen door.

In FIG. 4, when the train formation is parked in VPEZ6 and is not provided with a baggage carriage (all screen doors in a range of the train formation need to be opened), a screen door opening code sent by the VOBC is (bit7-bit0):

1 11 01001 (a driver's cabin activated in an upward direction)

0 01 01001 (a driver's cabin activated in a downward direction)

In this case, for the interlocking system, the two opening codes need to be recognized in data logic as representing opening all screen doors in a screen door area position 1, a screen door area position 2, and a screen door area position 3 and driving the same screen door opening relay.

Figure 5:
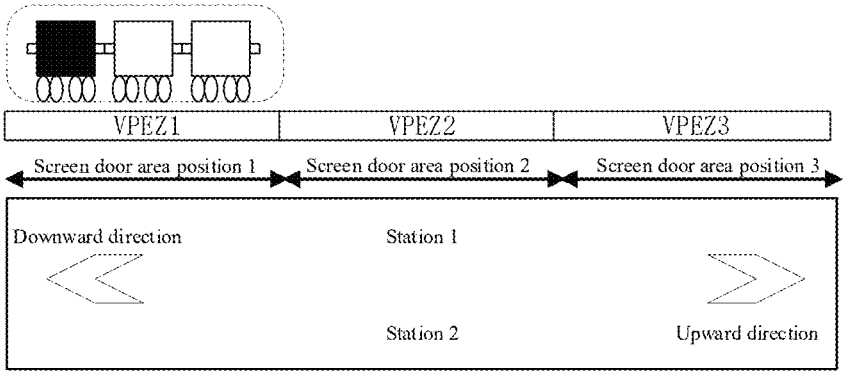
FIG. 5 is a schematic diagram of a train formation including one train unit, with a first carriage in a downward direction being a baggage carriage, according to the present invention.

In FIG. 5, when the train formation is parked in VPEZ1, and a first carriage in a downward direction is a baggage carriage (a screen door corresponding to the carriage is not opened), and a screen door opening code sent by the VOBC is (bit7-bit0):

1 01 00010 (two screen doors of train carriages are opened from a first screen door in an upward direction at the screen door area position 1 toward a downward direction)

Figure 6:
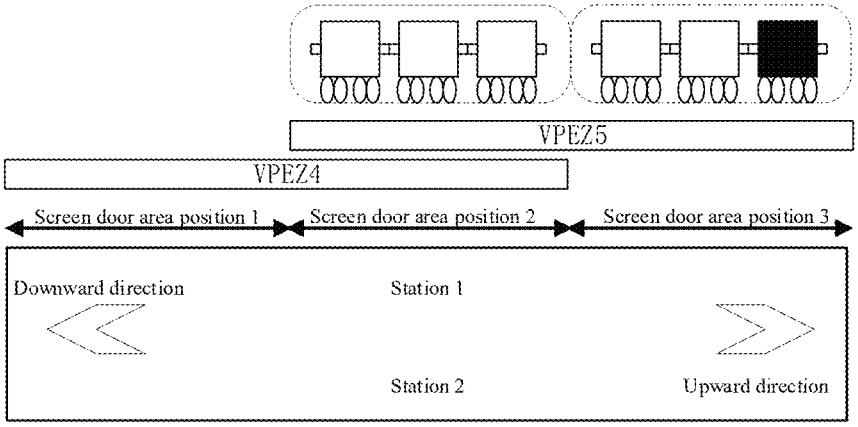
FIG. 6 is a schematic diagram of a train formation including two train units, with a first carriage in a downward direction being a baggage carriage, according to the present invention.

In FIG. 6, when the train formation is parked in VPEZ5, and a first carriage in the upward direction is a baggage carriage (a screen door corresponding to the carriage is not opened), and a screen door opening code sent by the VOBC is (bit7-bit0):

0 10 00101 (five screen doors of train carriages are opened from a first screen door in a downward direction at the screen door area position 2 toward the upward direction)

Figure 7:
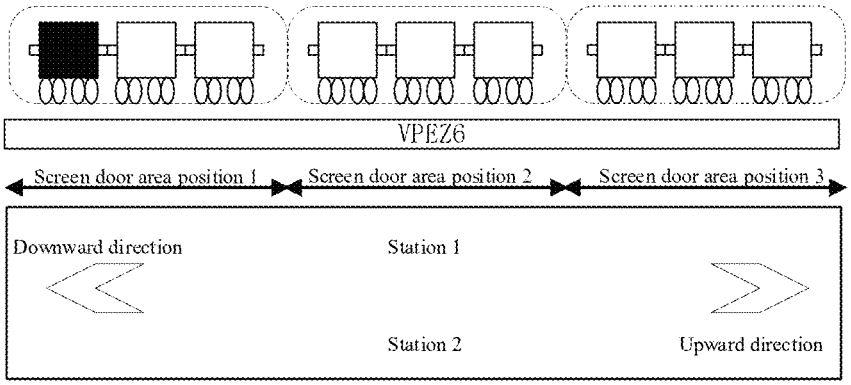
FIG. 7 is a schematic diagram of a train formation including three train units, with a first carriage in a downward direction being a baggage carriage, according to the present invention.

In FIG. 7, when the train formation is parked in VPEZ6, and a first carriage in a downward direction is a baggage carriage (a screen door corresponding to the carriage is not opened), and a screen door opening code sent by the VOBC is (bit7-bit0):

1 11 01000 (eight screen doors of train carriages are opened from a first screen door in an upward direction at the screen door area position 3 to a downward direction)

Based on the above explanation, it can be concluded that in the embodiment of the present invention, when a train formation including a plurality of train units is undergoing online formation splitting at the platform, a train formation including three train units is split into three separate train unit formations or split into one separate train unit formation and one column of two train unit formations. Boarding and alighting can be implemented for new train formations after splitting without the need for train movement.

Even if there is a baggage carriage in the train formation (and a corresponding screen door for the baggage carriage is not opened), the embodiment of the present invention can still meet the above requirements.

The embodiment of the present invention improves the flexibility of passenger boarding and alighting from a coupled train and baggage carriage at the platform, enhances the operation efficiency, and simplifies the workload for a dispatcher and driver.

The above is an introduction to the method embodiment. The following further describes the solution described in the present invention through embodiments of an electronic device and a storage medium.

The electronic device in the present invention includes a central processing unit (CPU), which can perform various proper actions and processing based on computer program instructions stored in a read-only memory (ROM) or computer program instructions loaded from a storage unit to a random access memory (RAM). The RAM also stores various programs and data that are necessary for device operation. The CPU, ROM, and RAM are connected to each other via a bus. An input/output (I/O) interface is also connected to the bus.

Several components in the device are connected to the I/O interface, including: input units, such as a keyboard, a mouse, and the like; output units, such as various monitors, speakers, and the like; storage units, such as a disk, an optical disc, and the like; and communication units, such as a network card, a modem, a wireless communication transceiver, and the like. The communication unit allows the device to exchange information/data with other devices through computer networks such as the Internet and/or various telecommunication networks.

The processing unit performs the methods and processing described above, such as the method S1-S4. For example, in some embodiments, method S1-S4 may be implemented as computer software programs that are tangibly included in a machine-readable medium, such as a storage unit. In some embodiments, some or all of the computer programs may be loaded and/or installed onto the device via the ROM and/or communication unit. When the computer programs are loaded into the RAM and executed by the CPU, one or more of the steps of method S1-S4 described above can be performed Alternatively, in other embodiments, the CPU may be configured to perform method S1-S4 in any other proper manners (for example, with the help of firmware).

Functions described above in the specification can be performed, at least in part, by one or more hardware logic components. For example, hardware logic components that can be used as examples include, unlimitedly, a field-programmable gate array (FPGA), an application-specific integrated circuit (ASIC), an application-specific standard product (ASSP), a system-on-chip (SOC), a complex programmable logic device (CPLD), and the like.

Program code for implementing the method in the present invention may be written in any combination of one or more programming languages. The program code may be provided to processors or controllers of general-purpose computers, specialized computers, or other programmable data processing devices, so that when the program code is executed by the processors or controllers, functions/operations specified in flowcharts and/or block diagrams are implemented. The program code can be executed entirely on a machine, partially on the machine, partially on the machine and partially on a remote machine as a separate software package, or entirely on the remote machine or server.

In the context of the present invention, a machine-readable medium may be a tangible medium that may contain or store programs for use by or in combination with an instruction execution system, apparatus, or device. The machine-readable medium may be either a machine-readable signal medium or machine-readable storage medium. The machine-readable medium may include, but is not limited to, an electronic, magnetic, optical, electromagnetic, infrared, or semiconductor system, apparatus, or device, or any proper combination thereof. A more specific example of the machine-readable storage medium includes an electrical connection based on one or more wires, a portable computer disk, a hard disk, a random access memory (RAM), a read-only memory (ROM), an erasable programmable read-only memory (EPROM or flash memory), an optical fiber, a portable compact disk read-only memory (CD-ROM), an optical storage device, a magnetic storage device, or any proper combination thereof.

The foregoing descriptions are merely implementations of the present invention, but are not intended to limit the protection scope of the present invention. Any equivalent variation or replacement readily figured out by a person skilled in the art within the technical scope disclosed in the present invention shall fall within the protection scope of the present invention. Therefore, the protection scope of the present application shall be subject to the protection scope of the claims.

What is claimed is:

1. A screen door control method supporting both coupling and a baggage carriage, specifically comprising:

step S1, calculating data of a safe passenger boarding and alighting area in an onboard electronic map library based on train running rules and train formations allowed for online running, and proceeding to step S2;

step S2, merging, by an interlocking system based on the train running rules and the train formations allowed for online running, same opening codes for actually opening screen doors in data logic, and proceeding to step S3;

step S3, calculating, by an onboard controller, a screen door opening code based on a current actual train formation, a baggage carriage condition, and data of a safe passenger boarding and alighting area in which the current train formation is located, sending the opening code to the interlocking system, and proceeding to step S4; and step S4, driving, by the interlocking system based on merging logic in step S2 and the screen door opening code received from the onboard controller, a corresponding screen door to be opened.

2. The screen door control method supporting both coupling and a baggage carriage according to claim 1, wherein a smallest unit of the train formation is a train unit, and one train formation comprises one or more train units coupled together.

3. The screen door control method supporting both coupling and a baggage carriage according to claim 1, wherein the safe passenger boarding and alighting area has five attributes: starting point coordinates, the length, a matched train formation type, a screen door area position at an upward end of the train formation, and a screen door area position at a downward end of the train formation.

4. The screen door control method supporting both coupling and a baggage carriage according to claim 3, wherein the starting point coordinates and the length define an area comprised in the safe passenger boarding and alighting area.

5. The screen door control method supporting both coupling and a baggage carriage according to claim 4, wherein the area is set at a different position on each platform based on actual needs of a project.

6. The screen door control method supporting both coupling and a baggage carriage according to claim 4, wherein the length is determined based on the length of a corresponding train formation and a train positioning error, and the train positioning error is calculated by a train automatic protection system based on beacon placement and odometer or speed sensor accuracy during parking.

7. The screen door control method supporting both coupling and a baggage carriage according to claim 3, wherein the screen door area position divides screen doors on an entire platform into several non-overlapping parts, and one screen door area is the length corresponding to one train unit.

8. The screen door control method supporting both coupling and a baggage carriage according to claim 1, wherein the opening codes are merged specifically as follows:

the interlocking system lists, based on the description of the train running rules and a train coupling and formation solution, all screen door opening codes that appear during project operation, and merges completely the same opening codes for actually opening screen doors into opening codes of the same type.

9. The screen door control method supporting both coupling and a baggage carriage according to claim 1, wherein a method for calculating the screen door opening code is consistent with an interface specification for interoperability, and logic for filling in fields is refined.

10. The screen door control method supporting both coupling and a baggage carriage according to claim 9, wherein refined fields comprise:

Bit7, defined as opening from an upward direction or a downward direction of a screen door area position toward a first screen door;

Bit 5-Bit6, defined as screen door area positions; and

Bit0-Bit4, defined as a quantity of train carriages with corresponding screen doors to be opened from a first screen door represented by Bit 5-Bit7 toward an opposite direction represented by Bit7.

11. The screen door control method supporting both coupling and a baggage carriage according to claim 10, wherein a method for determining the upward or downward direction is as follows: if no baggage carriage is provided for the train formations, the direction is a direction indicated by an activated driver's cab; otherwise, the direction is a direction indicated by a non-baggage carriage driver's cab; the screen door area position is: a screen door area position at which the activated driver's cab is located if no baggage carriage is provided for the train formations; otherwise, a screen door area position at which the non-baggage carriage driver's cab is located; and the quantity of train carriages is: a total quantity of carriages comprised in an entire train formation if no baggage carriage is provided for the train formations, or the baggage carriage is provided but a door for the baggage carriage in a current station needs to be opened; otherwise, the total quantity of carriages comprised in the entire train formation minus 1.

12. The screen door control method supporting both coupling and a baggage carriage according to claim 11, wherein the baggage carriage is a first carriage or last carriage of the entire train formation.

13. The screen door control method supporting both coupling and a baggage carriage according to claim 1, wherein the calculating data of a safe passenger boarding and alighting area in an onboard electronic map library in step S1 is performed by offline calculation.

14. The screen door control method supporting both coupling and a baggage carriage according to claim 1, wherein the calculating a screen door opening code in step S3 is performed by online calculation.

15. An electronic device, comprising a memory and a processor, wherein a computer program is stored in the memory, and when the processor executes the program, the method according to claim 1 is implemented.

16. A computer-readable storage medium, storing a computer program, wherein when the program is executed by a processor, the method according to claim 1 is implemented.

* * * * *